US008166950B2

(12) United States Patent
Scheuerell

(10) Patent No.: US 8,166,950 B2
(45) Date of Patent: May 1, 2012

(54) VARIABLE RATIO THROTTLE CONTROL

(75) Inventor: Alex Reuteman Scheuerell, Mayville, WI (US)

(73) Assignee: Deere & Company, Moline, IL (US)

( * ) Notice: Subject to any disclaimer, the term of this patent is extended or adjusted under 35 U.S.C. 154(b) by 640 days.

(21) Appl. No.: 12/342,134

(22) Filed: Dec. 23, 2008

(65) Prior Publication Data

US 2010/0154742 A1 Jun. 24, 2010

(51) Int. Cl.
*F02D 11/04* (2006.01)
*F02D 9/08* (2006.01)

(52) U.S. Cl. ..... 123/403; 123/400; 123/337; 123/584

(58) Field of Classification Search ..... 123/400, 123/403, 337, 584
See application file for complete search history.

(56) References Cited

U.S. PATENT DOCUMENTS 2,430,807 A * 11/1947 De Marco ..... 123/376
3,576,140 A 4/1971 Garman et al.
4,476,068 A 10/1984 Griffin et al.
4,502,436 A * 3/1985 Bonfiglioli et al. ..... 123/339.13
4,779,480 A 10/1988 Stocker
4,945,874 A * 8/1990 Nishitani et al. ..... 123/400
5,078,111 A 1/1992 McCann
5,239,891 A 8/1993 Stocker
5,423,299 A * 6/1995 Kumagai ..... 123/399
5,524,590 A * 6/1996 Jung ..... 123/400
5,699,768 A 12/1997 Saito et al.
6,167,867 B1 * 1/2001 Garrick ..... 123/400
6,202,626 B1 * 3/2001 Ito et al. ..... 123/336
6,729,298 B1 * 5/2004 Sterr ..... 123/339.13
7,017,552 B2 * 3/2006 Gerhardy ..... 123/400

* cited by examiner

*Primary Examiner* — Erick Solis

(57) ABSTRACT

A variable ratio throttle control is disclosed for an off road utility vehicle. The variable ratio throttle control includes a butterfly throttle on a throttle shaft pivotably mounted to a throttle body, a bell crank on the throttle shaft, and a lever extension extending radially from the bell crank to provide an extended lever arm until the butterfly throttle is partially open. A throttle cable is connected between an accelerator pedal and the lever extension, the throttle cable being displaceable by depressing the accelerator pedal to turn the extended lever arm. The lever extension abuts a kick plate once the butterfly throttle is partially open. The butterfly throttle may be fully opened by displacing the throttle cable to turn the bell crank after the lever extension abuts the kick plate.

11 Claims, 6 Drawing Sheets

VARIABLE RATIO THROTTLE CONTROL

FIELD OF THE INVENTION

This invention relates generally to throttle controls for off-road utility vehicle engines, and more specifically to a variable ratio throttle control.

BACKGROUND OF THE INVENTION

In terms of air flow, butterfly-type throttles for internal combustion engines are non-linear. For example, when an off-road utility vehicle operates at low throttle, a small change in throttle angle can produce a large power increase. However, when operating near maximum throttle, large changes in throttle angle provide a much smaller power increase. As a result, it is difficult to achieve sensitive low speed control of an off-road utility vehicle.

A non-linear relationship between pedal movement and power output is undesirable for an off-road utility vehicle. Additionally, most power is generated between 0% and about 30% of the accelerator pedal displacement, which may produce between 0 degrees and about 30 degrees of throttle opening angle. As a result, an operator must hold his or her foot at an uncomfortable angle on the accelerator pedal while driving at slow or intermediate speeds.

Variable radius throttle cams have been proposed but have not eliminated the low speed throttle sensitivity problem in off-road utility vehicles. One reason is that there may be insufficient cable displacement between the accelerator pedal and throttle for a cam profile to provide a sufficient difference between low and high throttle behavior.

Additionally, variable throttle controls that include multiple components may be more costly than is acceptable for use on many off-road utility vehicles, and the components may be subject to wear and/or malfunction from normal use. Examples include the devices shown in U.S. Pat. Nos. 4,779,480; 5,239,891; 3,576,140; 5,699,768; 5,078,111; and 4,476,068.

Accordingly, a variable ratio throttle control for an off-road utility vehicle is needed that is low in cost, and that minimizes the number of components that are subject to wear or malfunction. A variable ratio throttle control is needed that can provide a significant difference ratio between low and high throttle openings, with a short throttle cable displacement.

SUMMARY OF THE INVENTION

A variable ratio throttle control includes a bell crank mounted on an end of a throttle shaft with a lever extension pivotably connected to the bell crank. The bell crank and lever extension rotate together in a first direction to open the throttle partially, preferably to about 30 degrees. A kick plate blocks the lever extension from continuing to rotate together with the bell crank after the throttle opens partially. The throttle cable is connected between the accelerator pedal and the lever extension. The ratio of cable displacement to throttle opening angle is lower after the lever extension contacts the kick plate.

The variable ratio throttle control is low in cost, and minimizes the number of components that can wear or malfunction. The variable ratio throttle control provides a significant difference between low and high throttle behavior, with a short throttle cable displacement.

DESCRIPTION OF THE PREFERRED EMBODIMENT

In one embodiment shown in FIGS. 1-5, variable ratio throttle control 100 actuates a butterfly type throttle on throttle shaft 111. Throttle shaft 111 is pivotably mounted to throttle body 102 of an internal combustion engine for an off-road utility vehicle. Bell crank 115 may be fastened to an end of the throttle shaft, and a coil spring may bias the throttle toward the idle position of FIG. 1 so that the throttle valve opening angle at idle is about 0 degrees.

Figure 1:
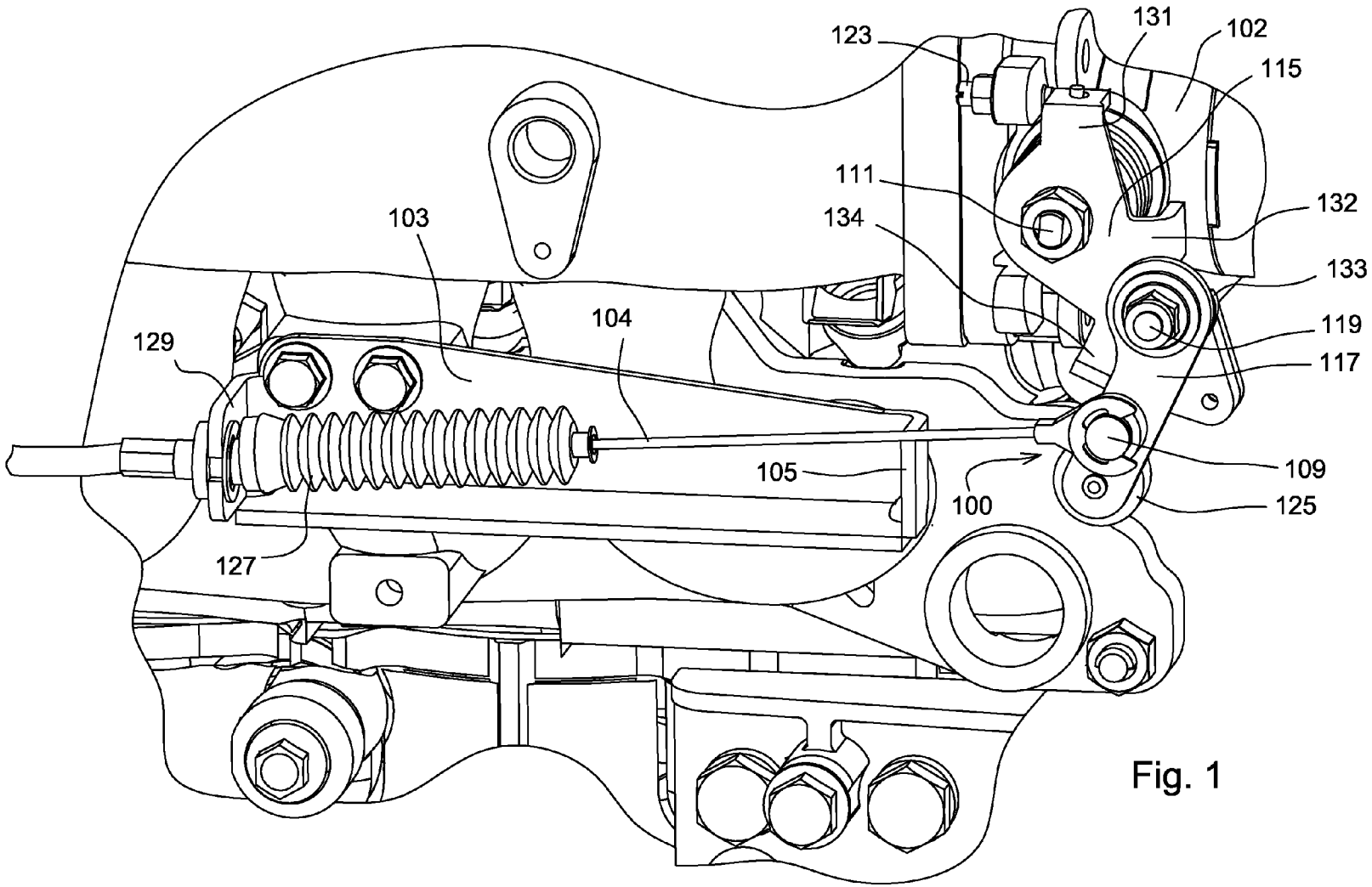
FIG. 1 is a perspective view of a variable ratio throttle control for an off-road utility vehicle at a throttle opening angle of 0 degrees according to a preferred embodiment of the invention.
Figure 2:
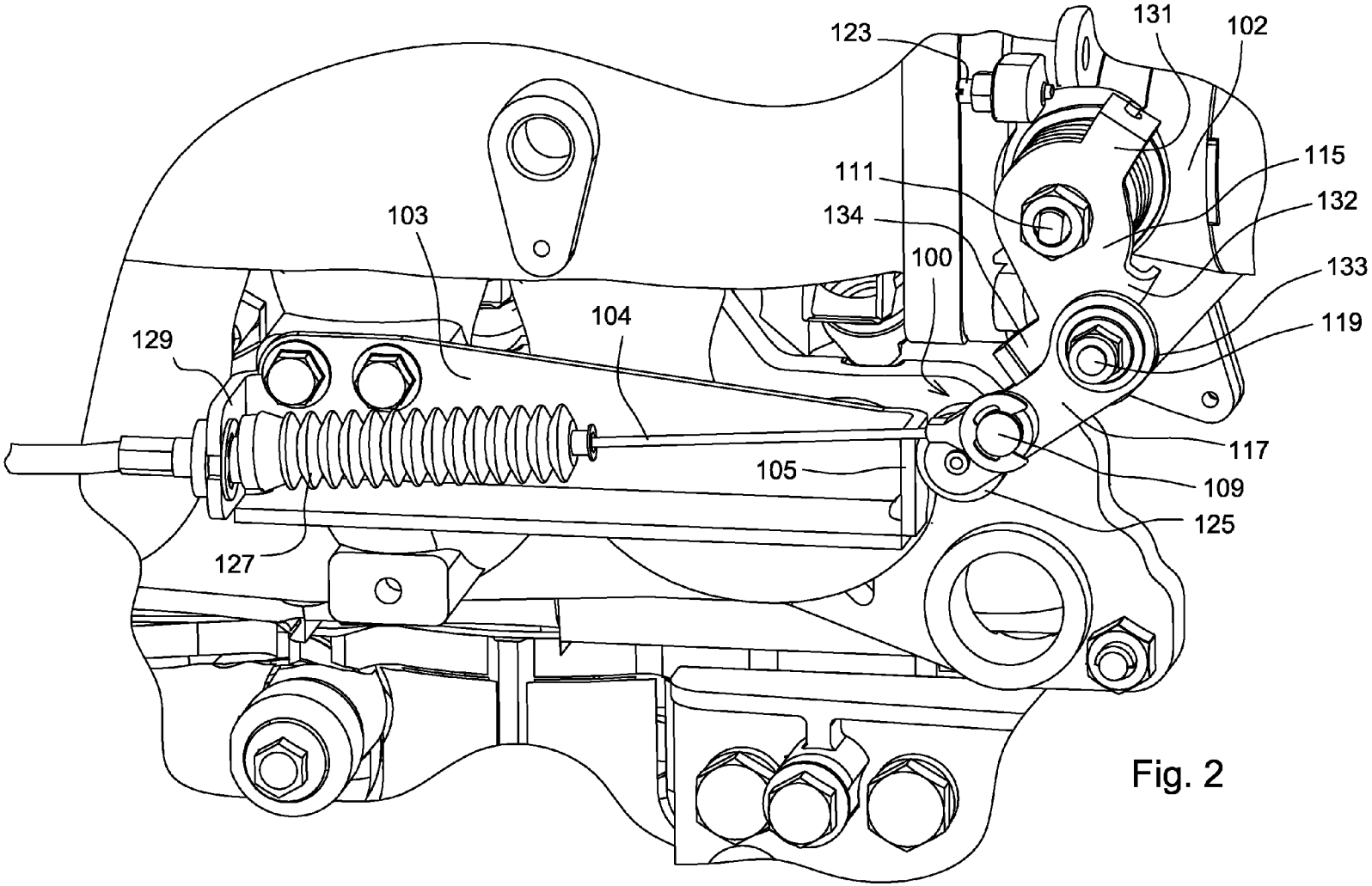
FIG. 2 is a perspective view of a variable ratio throttle control for an off-road utility vehicle at a throttle opening angle of 30 degrees according to a preferred embodiment of the invention.
Figure 4:
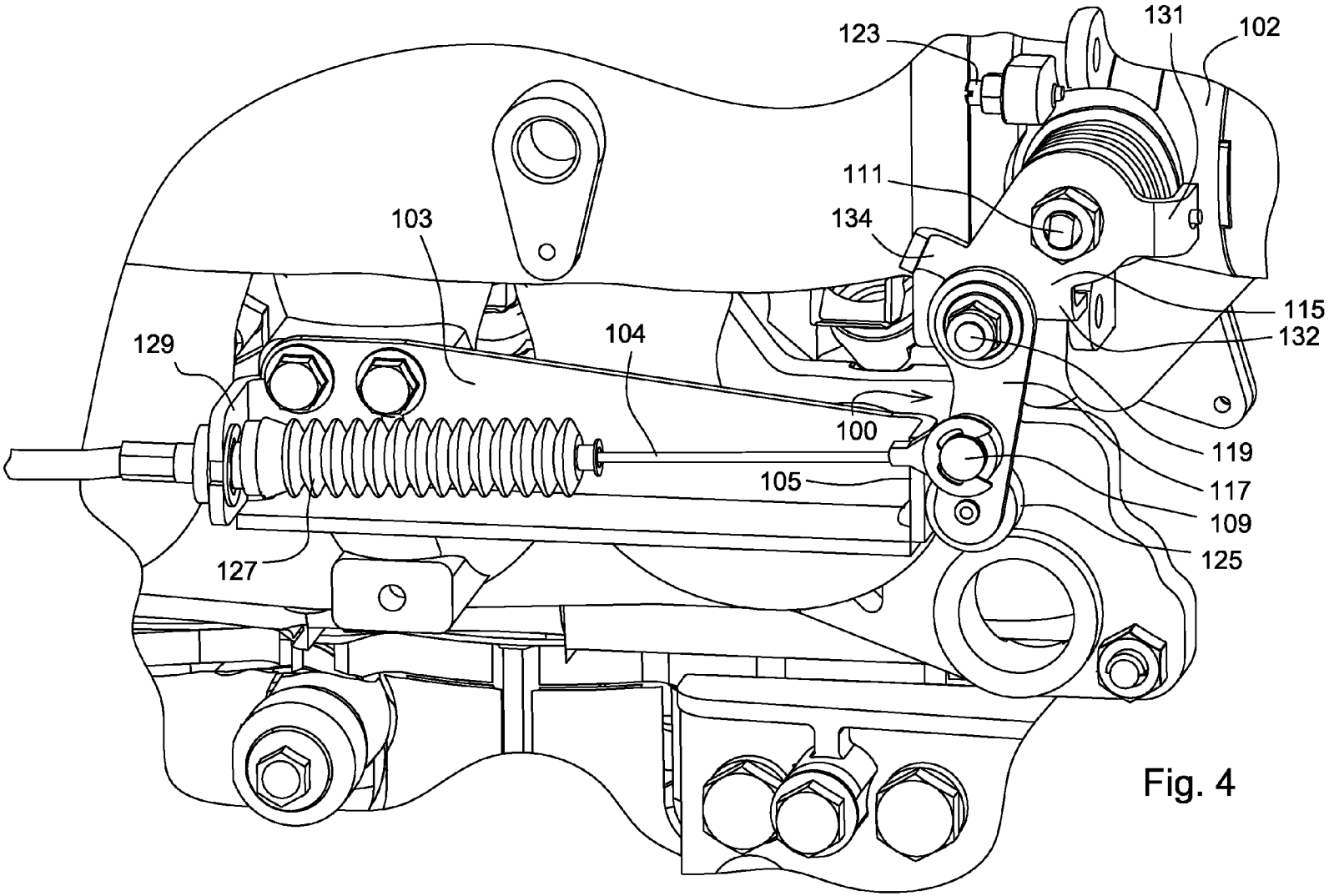
FIG. 4 is a perspective view of a variable ratio throttle control for an off-road utility vehicle at a throttle opening angle of 90 degrees according to a preferred embodiment of the invention.
Figure 5:
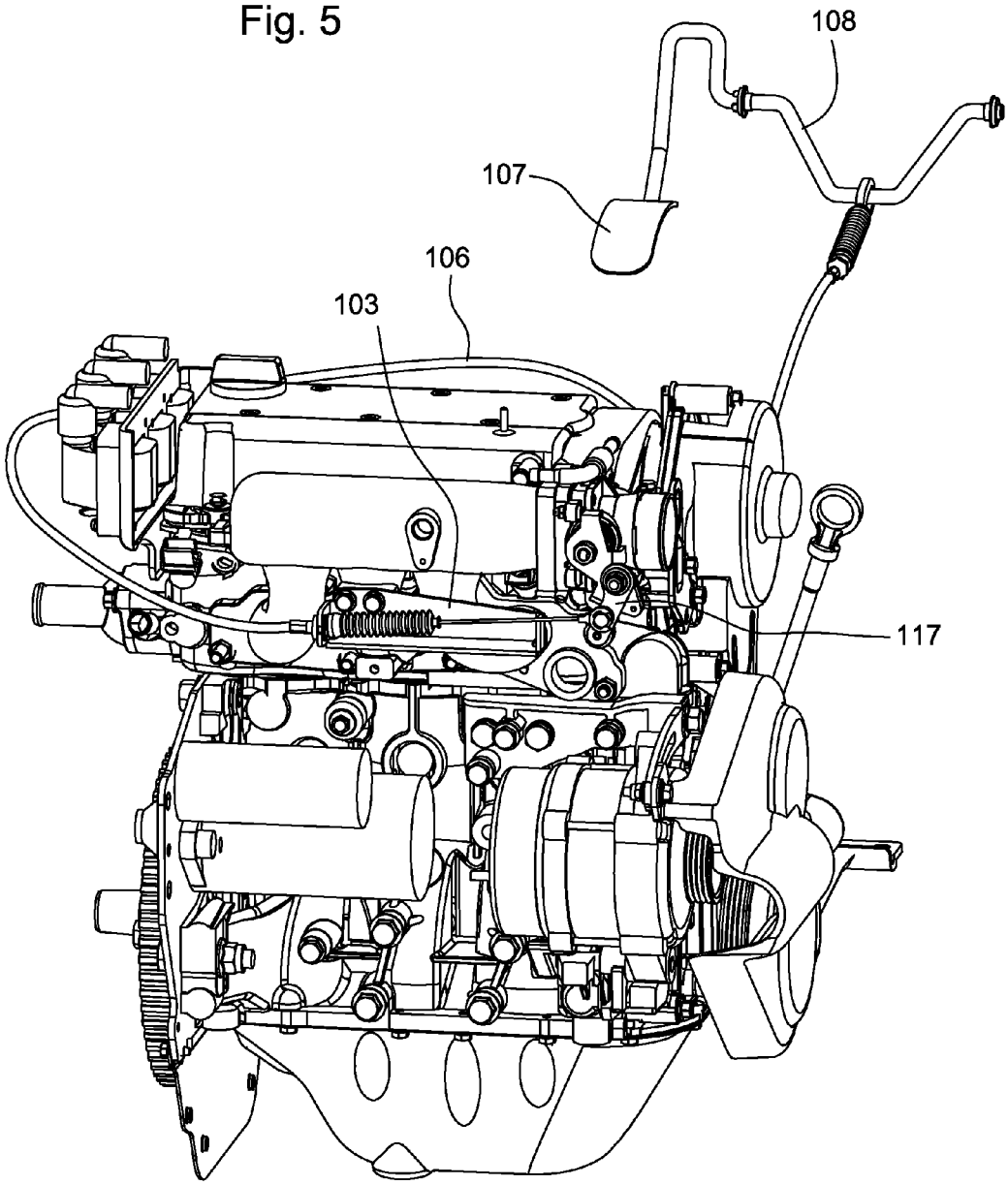
FIG. 5 is a perspective view of a an accelerator pedal linkage to a variable ratio throttle control according to a preferred embodiment of the invention.

In one embodiment, bell crank 115 has four arms 131-34 extending radially outwardly therefrom. In the idle position of FIG. 1, first arm 131 contacts or abuts idle screw 123. Second arm 132 provides a full throttle stop when the bell crank rotates until the second arm contacts a stop on or adjacent the throttle body, as shown in FIG. 4. Extension lever 117 is mounted with pivot connection 119 to third arm 133. In the idle position of FIG. 1, and until the throttle opens partially, preferably to about 30 degrees as shown in FIG. 2, lever extension 117 contacts or abuts fourth arm 134.

In one embodiment, accelerator pedal 107 may be connected to shaft or rod 108. As the accelerator pedal is depressed, shaft or rod pivots to displace throttle cable 104. The other end of throttle cable 104 is connected to post 109 attached to lever extension 117 between the first and second ends thereof. The throttle cable may be a Bowden cable enclosed within sheath 106. The first end of the sheath may be secured adjacent shaft or rod 108, and the second end of the sheath may be secured to collar 129 on bracket 103. Flexible protective sleeve 127 may cover a portion of the throttle cable between collar 129 and post 109.

In one embodiment, depressing the accelerator pedal displaces throttle cable 104 connected to post 109 of lever extension 117. For example, if the accelerator pedal is fully depressed from 0% to 100%, the total displacement of the throttle cable may be about 30 mm to 35 mm.

In one embodiment, until the throttle opens partially, preferably to about 30 degrees, lever extension 117 contacts or abuts fourth arm 134 on bell crank 115. As a result, until the throttle opens to about 30 degrees, lever extension 117 and bell crank 115 pivot together in the clockwise direction shown in FIG. 1, providing an effective lever arm length that is substantially longer than a standard throttle bell crank arm. For example, the effective lever arm length may be approximately 1½ times to 3 times the length of a standard throttle bell crank arm. The effective lever arm length of the variable ratio throttle control is from post 109 to throttle shaft 111, and preferably is between about one inches and about three inches. The longer effective lever arm provides higher throttle sensitivity during approximately the first 30 degrees of throttle opening.

In one embodiment, bracket 103 may be attached to an outer surface of the internal combustion engine with threaded fasteners or other means. The bracket may include collar 129 at or adjacent a first end thereof, and kick plate 105 at or adjacent a second end thereof. Kick plate 105 provides a stop for the first or lower end of lever extension 117 when the throttle is open partially, preferably at an angle of about 30 degrees.

Before lever extension 117 contacts kick plate 105, the ratio of cable displacement to throttle angle is very large. For example, the accelerator pedal displaces the throttle cable about 20 mm to about 25 mm, as shown graphically in FIG. 6, to open the throttle from 0 degrees to about 30 degrees. This represents between about 60% and about 80% of the maximum total displacement of the throttle cable using the accelerator pedal while only opening the throttle about 20% to about 40%.

In one embodiment, if the throttle is open partially, preferably about 30 degrees, as shown in FIG. 2, the first or lower end of lever extension 117 contacts kick plate 105. Bushing 125 (or a similar friction minimizing contact) may be provided on the first or lower end of lever extension 117. Once the first or lower end contacts the kick plate, lever extension 117 is blocked from moving further in the same clockwise direction and does not continue as an extended lever arm in unison with the bell crank.

In one embodiment, after lever extension 117 contacts the kick plate at a throttle opening angle of about 30 degrees, the accelerator pedal may continue to displace the throttle cable connected to post 109 so that lever extension 117 pivots in the opposite, counterclockwise direction. The first or lower end of lever extension 117 remains in contact with the kick plate as the accelerator pedal is used to open the throttle fully, preferably from about 30 degrees to about 90 degrees.

Figure 3:
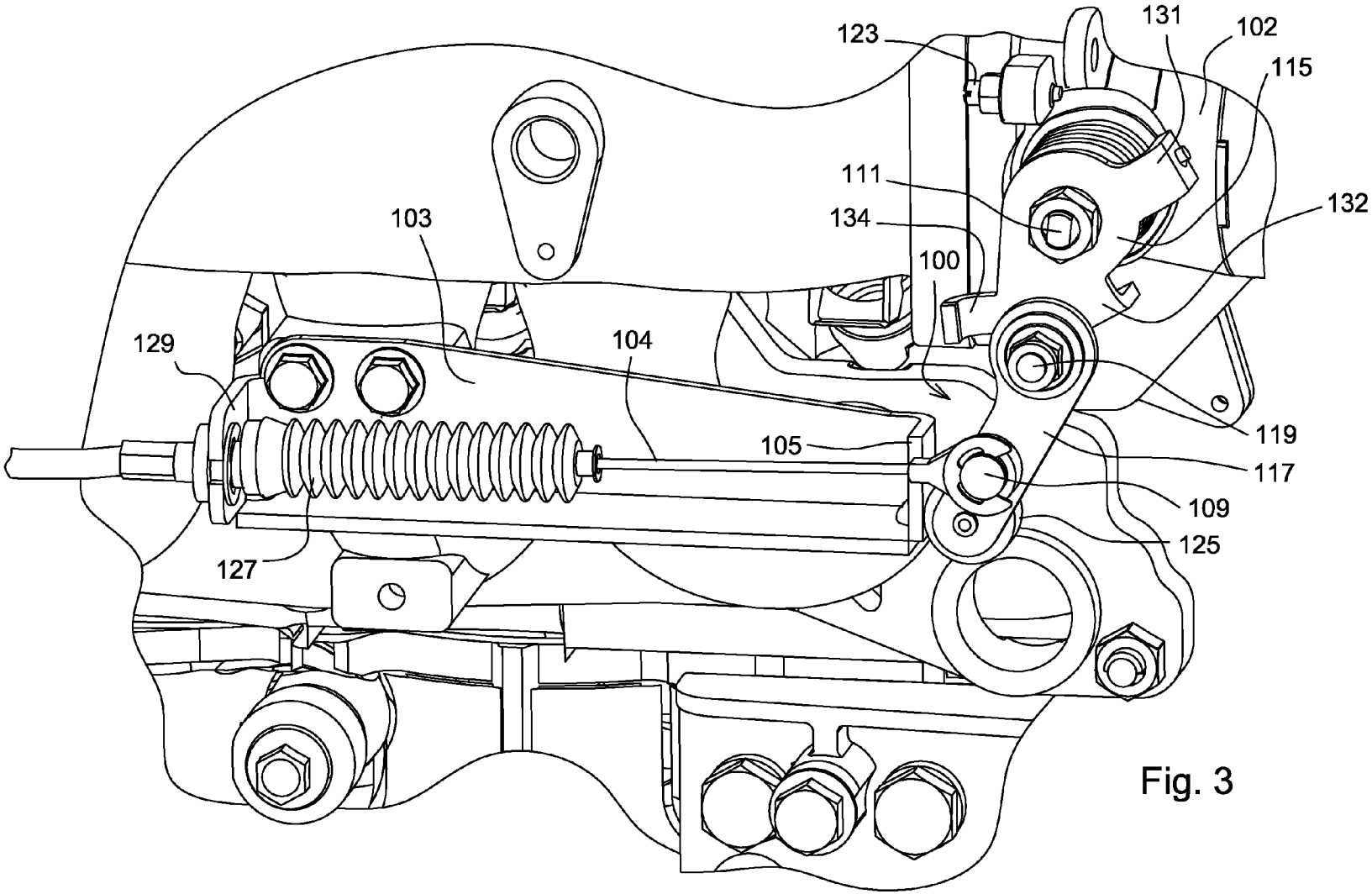
FIG. 3 is a perspective view of a variable ratio throttle control for an off-road utility vehicle at a throttle opening angle of 60 degrees according to a preferred embodiment of the invention.

In one embodiment, as shown in FIG. 3, counterclockwise rotation of lever extension 117 urges bell crank 115 to pivot clockwise. The second or upper end of lever extension 117 is pivotably connected to the bell crank, and the lever extension's counterclockwise rotation moves the fourth arm 134 of the bell crank away from the lever extension. As a result, the throttle can open fully, preferably between about 30 degrees and about 90 degrees, by depressing the accelerator pedal a relatively small amount. This cable displacement causes the bell crank to continue rotating clockwise after the lever extension contacts the kick plate.

Figure 6:
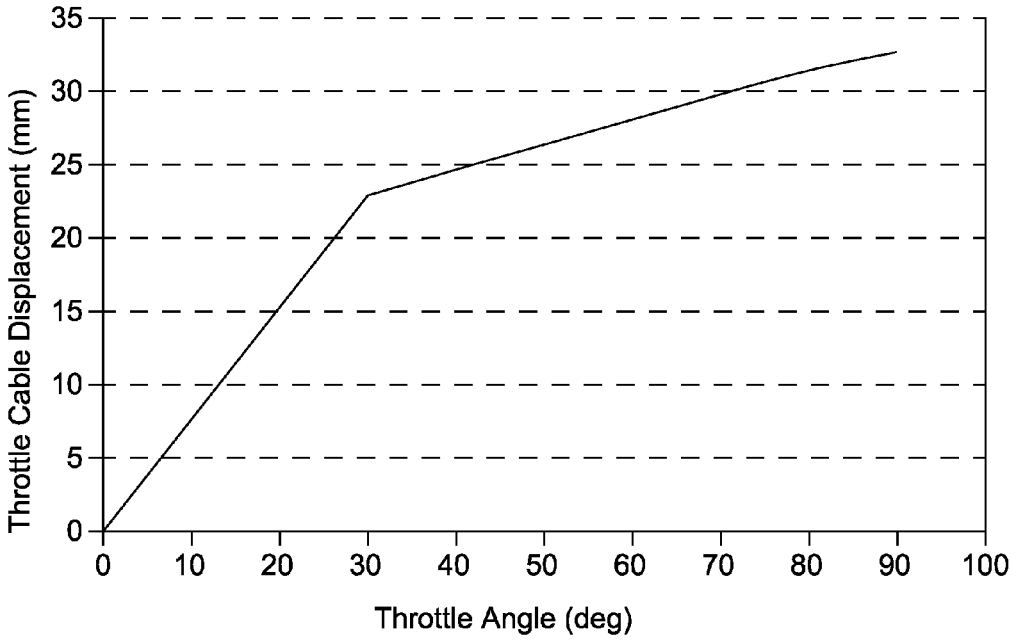
FIG. 6 is a graph depicting the relationship between throttle angle and throttle cable displacement according to a preferred embodiment of the invention.

After lever extension 117 contacts kick plate 105, the ratio of throttle cable displacement to throttle angle is very small. For example, the accelerator pedal displaces the throttle cable only about 10 mm to about 15 mm, as shown in FIG. 6, to open the throttle from about 30 degrees to about 90 degrees. This may represent between about 20% and about 40% of the maximum total displacement of the throttle cable using the accelerator pedal.

Having described a preferred embodiment, it will become apparent that various modifications can be made without departing from the scope of the invention as defined in the accompanying claims.

The invention claimed is:

1. A variable ratio throttle control, comprising:
a bell crank mounted on an end of a throttle shaft;
a lever extension pivotably connected to the bell crank;
the bell crank and lever extension rotating together in a first direction to open the throttle partially;
a kick plate blocking the lever extension from continuing to rotate together with the bell crank after the throttle opens partially; and
a throttle cable connected to a lower end of the lever extension, wherein displacement of the throttle cable after the lever extension contacts the kick plate rotates the lever extension in the first direction less than the bell crank rotates in the first direction to open the throttle between a partially open position and a fully open position.

2. The variable ratio throttle control of claim 1 further comprising a bushing on the lever extension contacting the kick plate.

3. The variable ratio throttle control of claim 1 further comprising an arm extending radially from the bell crank to which the lever extension is pivotably connected.

4. The variable ratio throttle control of claim 1 further comprising an arm on the bell crank contacting the lever extension until the lever extension contacts the kick plate.

5. A variable ratio throttle control, comprising:
a butterfly throttle on a throttle shaft pivotably mounted to a throttle body;
a bell crank on the throttle shaft;
a lever extension extending radially from the bell crank to provide an extended lever arm until the butterfly throttle is partially open; and
a throttle cable connected between an accelerator pedal and the lever extension, the throttle cable being displaceable by depressing the accelerator pedal to turn the extended lever arm;
wherein the displacement of the throttle cable after the butterfly throttle is partially open rotates the lever extension less than the bell crank rotates to open the throttle from a partially open position to a fully open position.

6. The variable ratio throttle control of claim 5 further comprising a kick plate that the lever extension abuts once the butterfly throttle is partially open.

7. The variable ratio throttle control of claim 6 wherein the butterfly throttle is fully opened by displacing the throttle cable to turn the bell crank after the lever extension abuts the kick plate.

8. The variable ratio throttle control of claim 5 wherein the lever extension is pivotably connected to the bell crank.

9. A variable ratio throttle control, comprising:
an accelerator pedal that may be depressed to displace a cable to open a throttle on a throttle shaft to a plurality of different throttle angles;
a bell crank on the throttle shaft and having a lever extension attached thereto that is connected to the cable;
the cable being connected to the lever extension between a first end where the lever extension is attached to the bell crank, and a second end where the lever extension contacts a kick plate;
wherein displacement of the cable after the lever extension contacts the kick plate rotates the lever extension less than the bell crank rotates to open the throttle between a partially open position and a fully open position.

10. The variable ratio throttle control of claim 9 further comprising a pivoting connection between the bell crank and the lever extension.

11. The variable ratio throttle control of claim 9 wherein the lever extension abuts the kick plate when the throttle opening angle is about 30 degrees.

* * * * *